United States Patent [19]

Erickson et al.

[11] 4,131,771

[45] Dec. 26, 1978

[54] ROTARY SWITCH WITH SPACED CIRCUIT BOARDS AND DISCRETE CONTACTS ON ROTOR OPPOSITE FACES ELECTRICALLY INSULATED FROM FURTHERMOST BOARD

[75] Inventors: Richard W. Erickson, Glendora; James Pallaske, Covina; Stephen Talbert, Pasadena, all of Calif.

[73] Assignee: Becton, Dickinson Electronics Company, Pasadena, Calif. ; by said Richard Erickson and James Pallaske

[21] Appl. No.: 785,076

[22] Filed: Apr. 6, 1977

[51] Int. Cl.[2] ..... H01H 19/58

[52] U.S. Cl. ..... 200/11 DA; 200/11 G; 200/14; 200/291

[58] Field of Search ..... 200/11 R, 11 A, 11 D, 200/11 DA, 11 G, 11 TW, 14, 38 B, 38 BA, 38 C, 38 CA, 266, 267, 292, 291

[56] References Cited

U.S. PATENT DOCUMENTS

| | | | |
|---|---|---|---|
| 2,056,919 | 10/1936 | Casper | 200/266 |
| 2,547,947 | 4/1951 | Kleis et al. | 200/266 |
| 3,258,830 | 7/1966 | Pityo | 200/267 X |
| 3,586,797 | 6/1971 | Gerhardt et al. | 200/292 X |
| 3,594,527 | 7/1971 | Brant et al. | 200/11 G X |
| 3,734,869 | 5/1973 | Menard et al. | 200/11 R |
| 3,786,205 | 1/1974 | Lien | 200/267 X |
| 3,794,784 | 2/1974 | Snider | 200/11 DA |
| 3,819,886 | 6/1974 | Homan et al. | 200/38 C X |
| 4,032,730 | 6/1977 | Golbeck et al. | 200/11 DA |
| 4,034,178 | 7/1977 | Koppenheffer et al. | 200/11 TW |

FOREIGN PATENT DOCUMENTS

| | | | |
|---|---|---|---|
| 2314277 | 10/1974 | Fed. Rep. of Germany | 200/11 DA |
| 221782 | 10/1968 | U.S.S.R. | 200/11 D |
| 239394 | 8/1969 | U.S.S.R. | 200/11 D |

OTHER PUBLICATIONS

Davis, W. M.; IBM Tech. Disc. Bull.; Wafer Switch; vol. 18; No. 10; 3-1976, pp. 3405, 3406.

Stengel, R. F.; Design News; "Rotary Switch Squeezes into Minimal Envelope", pp. 52, 53.

*Primary Examiner*—James R. Scott

[57] ABSTRACT

In multiple position rotary switch a pair of printed circuit boards are arranged adjacent opposite sides of a single brush bearing rotatable element. Brush blocks have a plurality of contacting extensions which may be selectively deleted in accordance with circuit design. The rotatable element includes an integral wheel having peripheral means in association with a detent in the housing for particularly positioning the wheel relative to the circuit boards for selectively connecting circuits thereon to establish desired switch connections.

8 Claims, 6 Drawing Figures

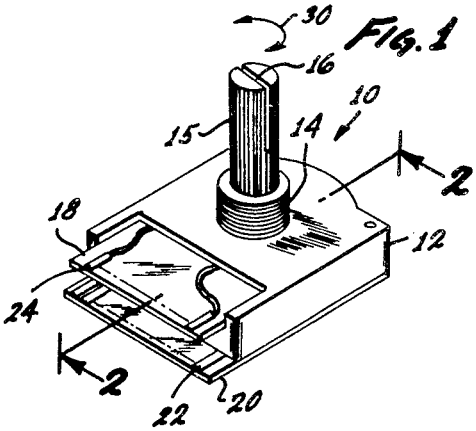
Fig. 1
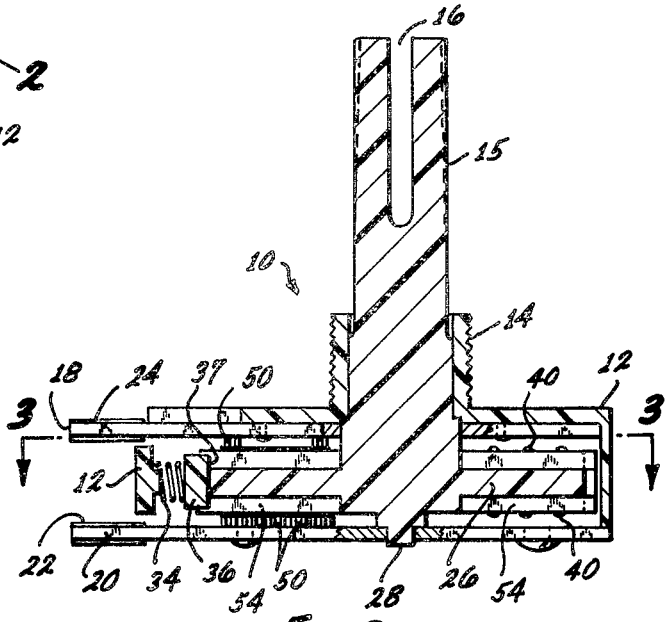
Fig. 2
Fig. 4
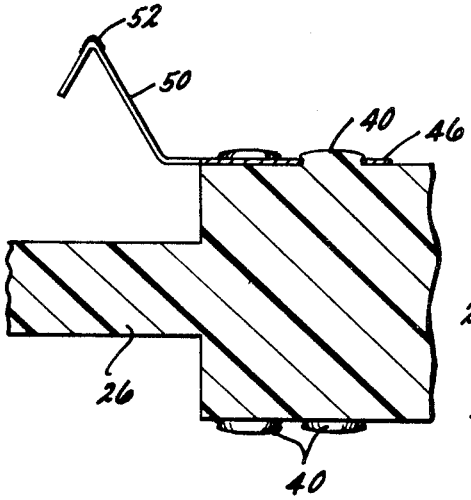
Fig. 3
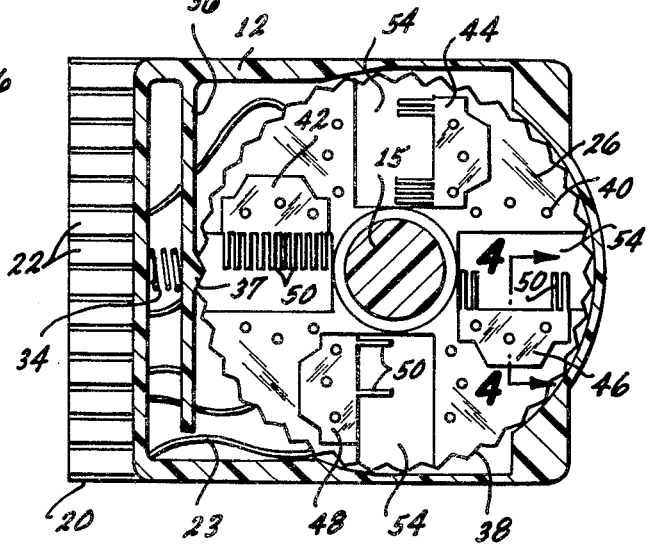

10
12
14
15
16
18
20
22
23
24
25
26
29
34
36
37
38
40
46
48
50
52
54
56
58
60
62
64
66

ROTARY SWITCH WITH SPACED CIRCUIT BOARDS AND DISCRETE CONTACTS ON ROTOR OPPOSITE FACES ELECTRICALLY INSULATED FROM FURTHERMOST BOARD

BACKGROUND OF THE INVENTION

1. Field of the Invention

This invention relates to rotatable selector switch assemblies, and more particularly to switch assemblies capable of completing discrete circuits turned to predetermined radio frequencies including printed circuits, in a module construction for providing a numerical display of the frequencies selected.

2. Description of the Prior Art

It has long been known to use selector switches employing rotary elements. The rotary element could be a printed circuit board or a printed wire board. Hereinafter in this specification, the terms "printed circuit board" and "printed wire board" shall be used interchangeably to indicate boards on which at least parts of electrical circuitry are etched or otherwise formed. Possibly, electrical component parts, such as resistors, capacitors, inductors, diodes, triodes and the like are mounted on the boards or electrically connected to the boards.

In cases where the rotary element contains such printed circuitry, common connected brush-type electrical contacts are positioned on stationary elements. Sundry switch connections are individually made as the rotary element is selectively turned. Alternatively, the circuitry on the rotary printed circuit board could provide the switch connections for otherwise open circuitry, having the brush contacts as leads.

Frequently the brush sets are mounted in modules having centers coaxial with the rotary element. A plurality of such printed circuits boards and brush modules in alignment provide for expanded switching capability. See, for example, McGee, U.S. Pat. No. 3,086,096 and Lockard, U.S. Pat. No. 3,809,830.

Other embodiments of such rotary switching constructions have a stationary printed circuit board. A rotary wheel having brush-type electrical contacts connects electrical circuits on the board as the wheel is selectively rotated. Most often the wheel is a thumbwheel. For a representative example of such construction, note Kendall, et al. U.S. Pat. No. 3,719,785. In some recent teachings, the wheel is turned by knobs connected to the shaft coaxial with the wheel. Representative of such construction would be Menard, U.S. Pat. No. 3,734,869 and MacDonald, U.S. Pat. No. 3,754,106.

Such switching assemblies have become more important in the effort to make radio transceivers and receivers more compact and portable. In some arrangements currently used as Citizen's Band (CB) radios, increased switching capability is desired and permitted by airwave regulations. In recent years, 23 channels were available and, since 1977, the number of channels was increased to 40. Increased switch circuitry may be added by the accumulative stacking techniques mentioned above. Such techniques are not ideal, however, because they necessarily require in the increase of circuitry, an almost proportional increase in bulk.

One teaching has the printed circuit board formed with circuit elements on both of its sides. Holes are provided connecting one side with the other. Connecting pins mechanically are inserted through the holes to form the switched connection. While interesting, the resulting assembly is still bulky and requires mechanically moving switch connectors.

It is desired to obtain a switch assembly having increased circuitry without the usually attandant increase in the number of modules or bulk. It is also desired to provide a switch assembly having virtually limitless numbers of switching connectors capable of variable circuit design connections.

SUMMARY

In brief, in accordance with one embodiment of the invention, two such printed circuit boards are arranged in parallel, spaced relationship. The printed circuit boards have circuit elements on at least the sides facing each other. The boards are mounted fixed in a housing having a bushing for a shaft to which a rotary element is attached. The rotary element may contain a virtually limitless number of brush contact sets having tips biased into engagement with the circuit elements on the printed circuit boards.

The brush sets are mounted optionally on either or both sides of the rotary element for making circuit connections in accordance with the selection of the rotary element position. Electrical contact leads from the circuit elements on the printed circuit boards are connected to circuit elements in radio transmitters, receivers or transceivers which also may be used to drive seven segment, light-emitting-diodes (LED) to indicate the selected channel or frequency.

The rotary element is constructed having a peripheral configuration complemental to a spring-biased detent, in order to limit movement of the rotary element to precise, discrete positions. The shaft held by the bushing can be connected to a control knob easily manipulated by a user. The brush sets have a plurality of contact brushes. Some of the contact brushes may be removed in accordance with circuit design consideration. The switch housing can be made compact, and capable of easy disassembly for changing the printed circuit boards or brush set configurations.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only, and are not intended as the definition of the limits of the invention.

BRIEF DESCRIPTION OF THE DRAWINGS

FIG. 1 is a perspective view of a preferred embodiment of the invention, showing the parallel printed circuit boards and rotary shaft;

FIG. 2 is a cross-sectional, elevational view taken along line 2—2 of FIG. 1 in the direction of the appended arrows showing the rotary element and detent spring;

FIG. 3 is a cross-sectional top view taken along line 3—3 of FIG. 2, in the direction of the appended arrows, showing the rotary element within the housing assembly;

FIG. 4 is an enlarged cross-sectional view taken along line 4—4 of FIG. 3, in the direction of the appended arrows, showing a brush tip in elevation;

DESCRIPTION OF THE PREFERRED EMBODIMENT

Figures 5, 6:
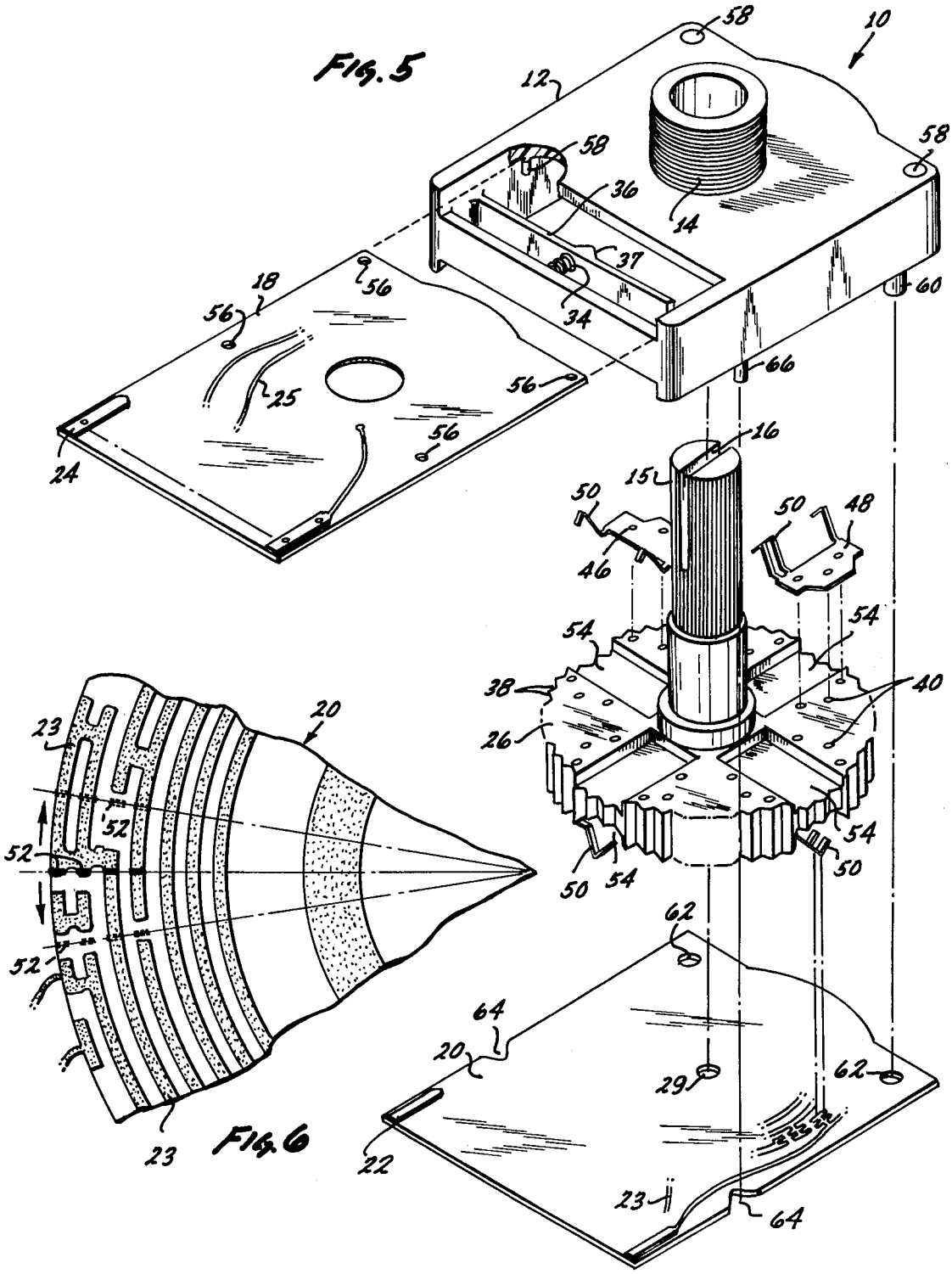
FIG. 5 is an exploded view of the preferred embodiment of the invention in elevation, showing the individually assembleable parts.
FIG. 6 illustrates a partial, plan view of circuit elements on the circuit boards of the preferred embodiment of the invention.

Referring initially to FIGS. 1, 2 and 3 in the accompanying drawings, a rotary switch assembly 10 is shown having a housing 12. A bushing 14 is formed in the housing to seat shaft 15 holding the rotary element to be described in greater detail below. The housing 12 receives printed circuit boards 18 and 20. Printed circuit board 20 has etched leads 22 for connection to circuit elements in a radio transmitter, receiver or transceiver system. Similarly, leads 24 are etched onto the surface of printed circuit board 18.

As seen better in FIG. 2, the wheel 26 is formed of the same unit as the shaft 15. The shaft has an end forked by indentation or slot 16 for allowing the connection of a knob or similar type instrument for turning the shaft and the wheel 26. The wheel 26 can be turned in either direction as indicated by the arrow 30.

The shaft 15 has at its opposite end a coaxial knob 28 for seating within a hole bushing formed in the printed circuit board 20. The printed circuit board 18 has a hole or bushing capable of admitting the shaft 15 therethrough. When the wheel 26 is assembled between the parallel positioning of printed circuit boards 18 and 22, a compact assembly having two printed circuit boards facing a single rotary wheel 26 is accomplished within the housing 12.

The printed circuit boards 18 and 20 are positioned firmly and stationarily with the housing 12. The wheel 26 and shaft 15, of course, can rotate freely in either direction as indicated by the arrow 30, within the assembly.

Spring 34 is positioned between housing wall 12 and a detent lever 36 having a slight detent 37, seen more clearly in FIG. 3 of the drawings. The detent 37 is adapted to engage serrations 38 in the wheel 26, by the biasing of the spring 34. The detent 37 may be a ratchet and the wheel 26 may be a ratchet wheel, if desired.

Brush sets 42, 44, 46 and 48 are positioned on the wheel 26 by the pins 40. Each brush set has originally some eight brushes 50 in the form of finger contact extensions from a common electrical connector base.

Brush set 42 is shown having all eight brushes 50. The brushes are designed to contact the printed circuit board having circuit components or elements facing the wheel 26. In the design of the circuits to be switched into an open or a closed position by the rotation of the wheel 26, it may be desirable not to employ all of the brushes in a set.

Consequently individual ones of the brushes 50 can be removed from the set prior to mounting it on the pins 44. Thus, brush set 44 has three such brushes removed. Brush set 48 has six such brushes 50 removed.

In FIG. 3, printed circuit board 20 is shown on the "far" side of the wheel 26. Circuit elements 23 etched or otherwise formed on the board 20 facing the opposite face, not shown, of wheel 26 are contacted by brushes, not shown, mounted on pins similar to pins 40 on the opposite face of the wheel 26. These brushes would contact various conducting areas or non-conducting areas of the printed circuit board 20 to close or open circuits, thus acting as a switch.

In the particular embodiment shown in the accompanying drawings, four wells 54 are formed on each side of the wheel 26. The wells 54 provide an identation into which the brushes 50 may be pressed by the close assembly of the wheel between the parallel printed circuit boards 18 and 20. Brush sets can be mounted on the wheel 26 on both radial sides of the wells 54 optionally in accordance with the circuit designer's scheme.

Each brush set, however, is separate from brush sets in close proximity so that there is no electrical contact between the brush sets, either through adjacent brushes 50 or through the common connector of the sets mounted on the pins 40. The wheel 26 is of an appropriate electrically insulative material to further isolate electrical connection in the switching assembly.

As seen particularly in FIGS. 2 and 3, the wheel 26 substantially covers the conductive area of the boards 18 and 22, substantially dividing the housing 12 into two sections. The wheel 26 isolates any electrical connection of board 18 from brushes 50 on the wheel's far side, and isolates any electrical connection of board 20 from brushes 50 on the wheel's far side therefrom.

As seen more clearly in FIG. 4, the brush 50 may be coated at its tip with an electrically conductive, hard material to increase the wear resistance of the brush 50. The hardened material 52 may be, for example, a precious metal, such as gold, or could be an impregnation of a hardening alloy, such as tungsten carbide.

The assembly of the rotary switch system can be visualized easily from the exploded view of FIG. 5. Printed circuit board 18 is inserted through an opening into the housing 12. Holes 56 formed on the printed circuit board 18 are aligned to receive pins 58. The pins 58 may be melted to hold or to stake securely the printed circuit board 18 onto the housing 12.

The brush sets, such as brush sets 46 and 48 are mounted on the wheel 26 through the pins 40 as described above. The brushes 50 extend over the wells 54. When the shaft 15 is mounted within bushing 14 so that the wheel 26 comes into close proximity to the printed circuit board 18, the brushes 50 are depressed slightly by contact with the printed circuit board 18, into the wells 54.

Printed circuit board 20 is then mounted parallel to the wheel 26 and printed circuit board 18. The printed circuit elements 23 of printed circuit board 20 face the wheel 26 and are contacted by the brushes 50 on the side of the wheel 26 obscured from view in FIG. 5. Holes 62 are adapted to receive the pins 60 of the housing 12. Notches 64 are formed in alignment with the pins 66 on the housing 12. Slight melts of the pins 60 and 66 will then firmly secure the printed circuit board 20 to the housing 12 and in the assembly 10. Coaxial knob 28 on the shaft 15 should align and seat within the hole 29 formed in the printed circuit board 20.

When so assembled in close proximity as indicated, the tips 52 of the brushes 50 will directly contact either conducting portions or non-producting portions of the printed circuit boards. As illustrated in FIG. 6 of the drawings, the tips 52 can contact the circuit elements 23 of printed circuit board 20 shown. As the wheel 26 is rotated in either direction about the axis of the shaft 15, the contacts 52 will maintain contact with conducting portions or with non-conducting portions. Since all of the brushes on a set have a common electrical connection, circuit legs or elements 23 on the printed circuit board 20 can be switched into completed circuits or switched into open circuits in accordance with the electrical scheme or design of the printed circuit board.

The particular wheel of the preferred embodiment is contemplated to have some forty detent serrations 38 around its peripheral edge. The wheel 26, therefore, will have forty discrete rotary positions as determined by the detent 37 biased into engagement with the periphery of the wheel 26 by the spring 34.

Etched contact leads 22 and 24 on the respective printed circuit boards 20 and 18 can contact circuit elements in an electrical unit, not shown, in which it is desired to have switched circuit elements such as pretuned circuits for receiving or transmitting radio frequencies. In the particular design shown, nine such contact leads 22, 24, are shown for each printed circuit board so that two, seven segment light emitting diode arrangements can be operated or driven through the switching arrangement of the present invention to display channel numbers corresponding to the selected frequencies.

The nine segments can be used to provided some 511 different number combinations in a binary oriented number circuit. If the circuits comprising the switched connection are used also to drive the LED display in, for example, a series connection, the nine segments of the second printed circuit board may be used to provide a much greater number capability. These arrangements could be used easily to switch aircraft radio and display systems.

In summary, it may be seen that a dual printed circuit board switching assembly is provided having only a single, unitary rotating element. The rotating element has brush contact sets on both sides of its circular faces adapted to make electrical circuit connections on the faces of the printed circuit boards facing the wheel.

An infinite number of brush sets can be mounted on either face, depending on design choice, for making an infinite variety of circuit switch connections possible on the printed circuit boards. A detent lever, spring biased into engagement with detents on the periphery of the rotating element, provides for a controlled, discrete number of switch brush contact positions.

The almost infinite number of brush sets and brushes can provide switched circuit connections to drive any kind of electronic display. A further variation can be accomplished by eliminating the detent. Such an arrangement can be used as a shaft encoder. The display would be capable of indicating the rotor shaft position.

Although a particular embodiment of the invention has been described and illustrated herein, it is recognized that modifications and equivalents may readily occur to those skilled in the art. Consequently, it is intended that the claims be interpreted to cover such modifications and equivalents, and that the invention be limited only thereby.

What is claimed is:

1. A multiple position rotary switch in a housing having an area defined in two mutually orthogonal directions, said switch comprising:

switch contact means for selectively closing electrical circuits upon contact, said means including an electrically insulating rotatable wheel extending substantially across said area substantially dividing said housing into a first section and a second section having first and second sides and having mounting means on both said first and second sides for selectively attaching a plurality of contact brush sets electrically isolated from each other;

a first printed circuit board positioned stationary relative to the wheel in said first housing section, said first board having electrical conductors positioned thereon facing the said first wheel side, the said circuits of said board being adapted to be closed selectively upon contact of said conductors with the brush sets on said wheel; and a second printed circuit board positioned stationary relative to the wheel in said second housing section, said second board having electrical conductors positioned thereon facing the said second wheel side, said circuits of said second board being adapted to be closed selectively upon contact of said conductors with the brush sets on said wheels;

wherein said first wheel side substantially covers said electrical conductors positioned on said first printed circuit board, and said second wheel side substantially covers said electrical conductors positioned on said second printed circuit board to isolate any electrical connection of said first board from brushes on said second wheel side, and to isolate any electrical connection of said second board from brushes on said first wheel side.

2. The multiple position rotary switch of claim 1 further comprising a detent engaged by serrations on a periphery of the rotatable wheel.

3. The multiple position rotary switch of claim 2 further comprising a spring biasing the separate detent into engagement with the periphery of the rotatable wheel, and wherein the serrations on the rotatable wheel are spaced to limit the movement of the rotatable wheel to discrete rotatable positions of the rotatable wheel.

4. The multiple position rotary switch of claim 3 wherein said first and said second printed circuit boards are fixed in parallel within said housing in spaced relationship with each other, and having bushings for rotatably mounting the wheel between the said first and the said second printed circuit boards in such close proximity such that the brush sets mounted on said wheel are urged into contact with faces of the printed circuit boards facing opposing sides of the said wheel.

5. The multiple position rotary switch of claim 1 wherein each said brush sets includes a plurality of brushes each extending from the set and electrically connected with the other brushes on the set, each brush formed to extend beyond the side of the wheel on which the brush set is mounted, for engagement with a respective printed circuit board and conductors positioned thereon.

6. The multiple position rotary switch of claim 5 wherein each brush set, the brushes extending from the common connection are selectively removable from the set.

7. The multiple position rotary switch of claim 5 wherein the brush extension adapted to contact a respective printed circuit board and conductors thereon is coated with an electrically conductive, wear-resistant material.

8. The multiple position rotary switch of claim 7 wherein the electrically conductive, wear-resistant material comprises a precious metal.

* * * * *